United States Patent [19]

Soeters, Jr.

[11] Patent Number: 4,704,995

[45] Date of Patent: Nov. 10, 1987

[54] GUIDE FOR ROLLER CAM FOLLOWER

[75] Inventor: Raymond A. Soeters, Jr., West Bloomfield, Mich.

[73] Assignee: Eaton Corporation, Cleveland, Ohio

[21] Appl. No.: 894,289

[22] Filed: Sep. 27, 1985

Related U.S. Application Data

[60] Division of Ser. No. 669,694, Nov. 8, 1984, abandoned, which is a continuation of Ser. No. 384,698, Jun. 3, 1982, abandoned.

[51] Int. Cl.[4] ..... F01L 1/14

[52] U.S. Cl. ..... 123/90.5; 123/90.65

[58] Field of Search ..... 123/90.48, 90.50, 90.65, 123/90.67

[56] References Cited

U.S. PATENT DOCUMENTS

| | | | |
|---|---|---|---|
| 1,011,695 | 12/1911 | Winton | 123/90.5 X |
| 2,089,478 | 8/1937 | Heiss | 123/90.5 |
| 2,119,096 | 5/1938 | Buckley | 123/90.5 |
| 3,089,472 | 5/1963 | Thompson | 123/90.5 |
| 4,207,775 | 6/1980 | Lintott | 123/90.5 X |

*Primary Examiner*—William R. Cline
*Assistant Examiner*—Peggy Niels
*Attorney, Agent, or Firm*—D. A. Rowe; F. M. Sajovec

[57] ABSTRACT

A guide (28) is provided for retrofitting an existing internal combustion engine block (10) with roller cam followers (24 and 26) in place of conventional barrel-type lifters, without modification of the block itself. The guide includes a guide bar (64), keyed to the upper body (38) of each follower to allow limited rotational freedom thereof and a resilient C-shaped spring clip (70) which simultaneously bears downwardly on the upper surface of the guide bar and upwardly on the lower surface (40) of an engine block boss (18) defining follower receiving bores (20 and 22). Annular spacers (72) are provided, if required, to displace the guide bar upwardly from the upper surface (52) of the boss. An upper leg (76) of the spring clip wraps around the guide bar for retention therewith and a lower leg (78) of the spring clip is necked at a point (86) intermediate adjacent cylindrical portions (30 and 32) of the follower boss for retention therebetween.

3 Claims, 7 Drawing Figures

GUIDE FOR ROLLER CAM FOLLOWER

This application is a division of Ser. No. 06/669,694 filed 11/8/84 now abandoned which is a continuation of Ser. No. 06/384698 filed 6/3/82 now abandoned.

FIELD OF THE INVENTION

This invention relates generally to lash adjusters employed in valve trains within internal combustion engines and particularly to the application of roller cam followers within such valve trains.

BACKGROUND OF THE INVENTION

Internal combustion engines have traditionally employed some form of valve gear lash adjustment. Typically, lash adjustment is accomplished mechanically or hydraulically. Of the hydraulic type, the most prevalent is the barrel lifter which comprises a generally cup-shaped body slidably disposed in a bore provided therefor in the engine block to contact the engine driven cam, and a piston disposed within the body to transmit movement from the lifter to the pushrod.

It is particularly important in valve lifter construction that the surface operating against the cam be formed of a wear resistant material and that the lifter body rotate within the block to ensure uniform wear of its cam engaging surface.

Recently, roller cam followers have become more popular as a method of lowering valve train friction and thus increasing engine efficiency. Roller cam followers typically comprise a cylindrical body portion which supports a roller at one end thereof for rotation about an axis parallel to the axis of the cam. Provision, however, must be made to ensure against rotation of the follower body. Such rotation would cause misalignment of the cam and roller axes, resulting in scuffing therebetween, undue wear and shortened service life. The most prevalent prior art approach for preventing the rotation of follower bodies is the rigid keying thereof to the engine block. This approach, however, has shortcomings in that it requires that precise rotational alignment be maintained between the roller and cam axes, not only at the time of manufacture but during the life of the engine. No accomodation has been made for dimension and material variations found in all manufacturing processes, or for wear induced variations. Finally, prior art implementations of roller cam followers necessitte substantial modification or redesign of the engine block itself, which is extremely expensive.

BRIEF DESCRIPTION OF THE INVENTION

The present invention overcomes the above described shortcomings of the prior art by providing a roller cam follower guide suitable for retrofitting an internal combustion engine of the type including a valve gear with one or more roller cam followers and a boss within the block characterized by an upper surface and a bore for slidably receiving the follower. According to the present invention, the guide includes a member which is keyed to each follower at a point adjacent the upper surface of the boss and which operates to limit rotational freedom of the follower within its bore, and apparatus for providing resilient interconnection between the member and the block. This arrangement has the advantage of providing an extremely inexpensive and simply constructed guide for a roller cam follower for installation within a conventional internal combustion engine and particularly for the retrofitting thereof.

According to the preferred embodiment of the invention, the resilient connection between the guide bar and the block is effected by a biasing spring which bears downwardly on the guide and upwardly on the bottom surface of the engine head. This arrangement has the advantage of providing simple construction and installation without special tools.

According to another aspect of the invention, provision is made for rigidly spacing the member or guide bar a predetermined distance above the top surface. This arrangement has the advantage of enhancing retrofitability of existing engine blocks with roller cam followers employing the present invention, even when the requisite follower has an axial dimension greater than that contemplated in the original design of the block.

According to another aspect of the invention, the biasing spring is provided with means for attachment to the guide bar, namely, an end which circumferentially embraces the guide bar around at least a portion of the periphery thereof. This arrangement has the advantage of restricting the ends of the biasing spring in most directions of displacement freedom to ensure that the spring and guide bar will remain in their intended installed positions.

According to still another aspect of the present invention, a single guide bar is keyed to all of the followers in a given bank of an engine. This arrangement has the advantage of requiring only one guide bar and, preferably, two biasing springs, for each cylinder bank, to minimize part count and accompanying costs.

These and other features and advantages of this invention will become apparent upon reading the following specification, which, along with the patent drawings, describes and discloses a preferred illustrative embodiment of the invention in detail.

A detailed description of the specific embodiment makes reference to the accompanying drawings.

DETAILED DESCRIPTION OF THE SPECIFIC EMBODIMENT

Figure 1:
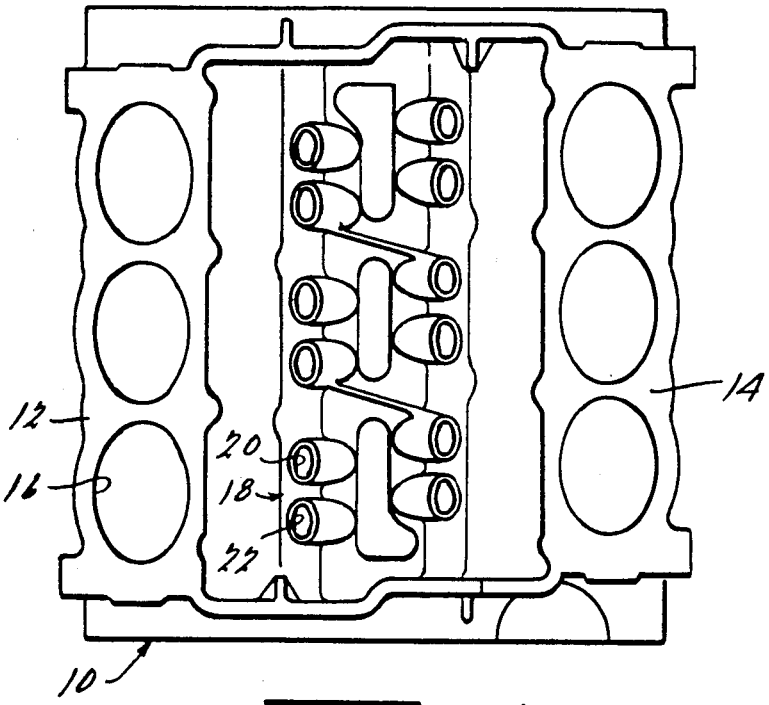
FIG. 1, is a top plan view of a typical internal combustion engine cylinder block which could accomodate the present invention.

Referring to FIG. 1, the present invention is intended for application within the block 10 of a conventional internal combustion engine, which is of a V-configuration well-known in the art, comprising left and right banks 12 and 14, respectively. Each bank 12 and 14 defines three in-line cylinders 16, each having a boss, shown generally at 18, associated therewith and defining two substantially parallel bores 20 and 22 therein for receiving roller cam followers.

Although illustrated in the environment of a V-configured internal combustion engine, it is contemplated that the present invention, in its broadest sense, could be employed in other cylinder configurations, such as in-line.

Figure 2:
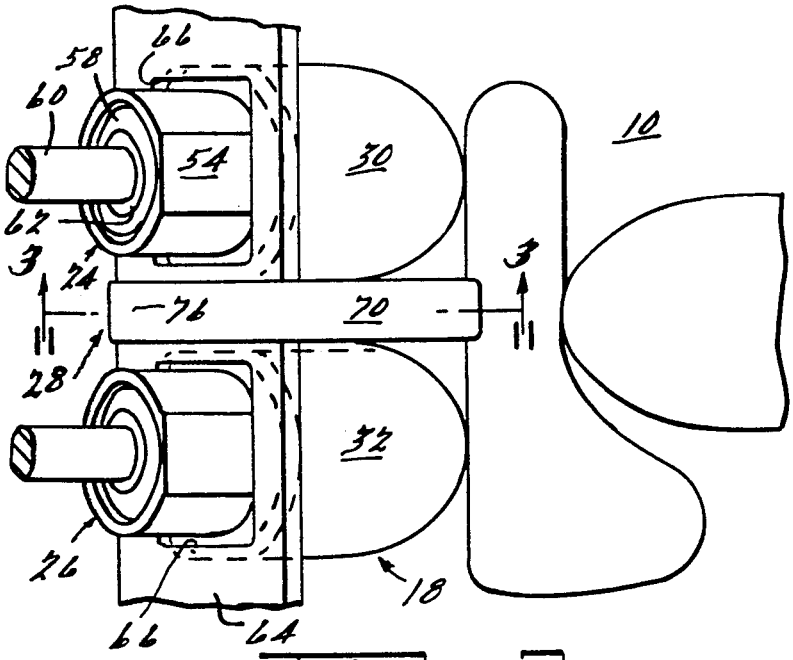
FIG. 2, is an enlarged fragmented view of a portion of the cylinder block of FIG. 1, illustrating the application of the present invention.
Figure 7:
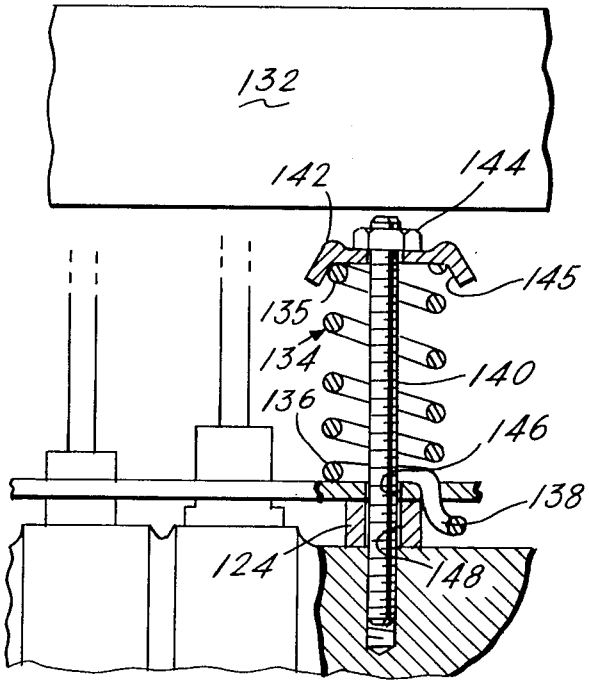
FIG. 7 is a niew similar to FIG. 6 and illustrates a variant.

Referring to FIG. 2, a fragmented portion of block 10 is illustrated with roller cam followers 24 and 26 installed within bores 20 and 22, respectively and retained rotationally in their illustrated position by a roller cam follower guide indicated generally at 28. Because followers 24 and 26 are generally known in the art, the internal details thereof and operation will be deleted here for the sake of brevity.

Figure 5:
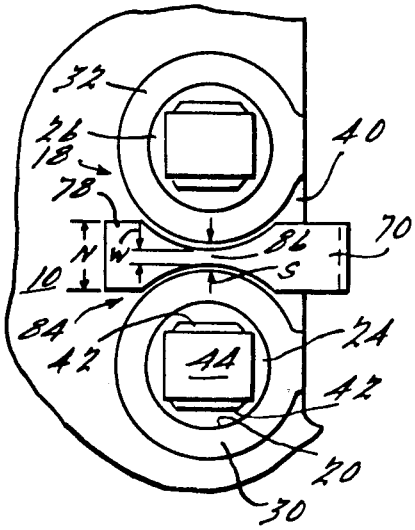
FIG. 5, is a view taken along lines 5—5 of FIG. 3.
Figure 3:
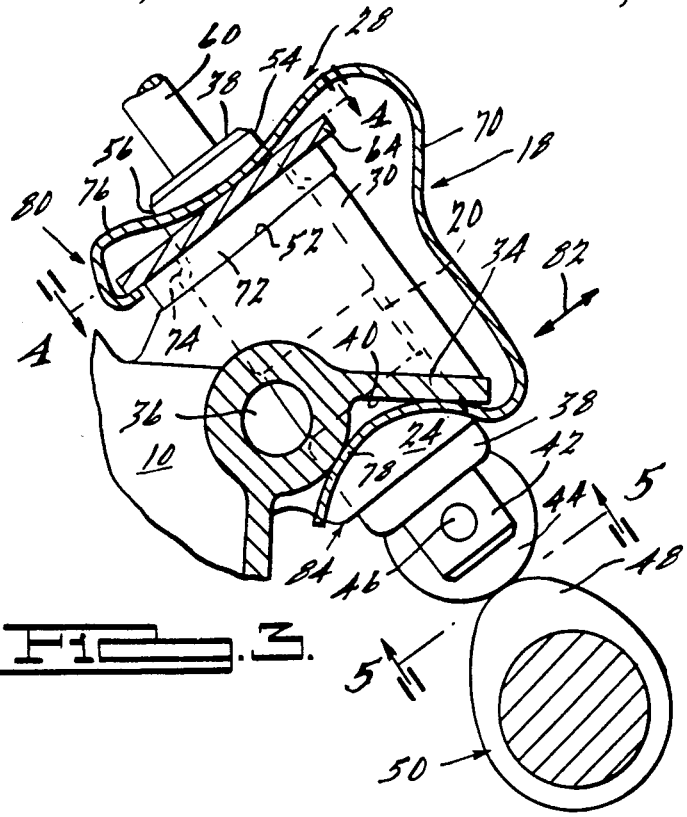
FIG. 3, is a cross-sectional view taken on line 3—3 of FIG. 2.

Referring simultaneously to FIGS. 2, 3 and 5, boss 18 is composed of two cylindrical portions 30 and 32 and an interconnecting web 34, all integrally formed by casting with block 10. Bores 20 and 22 are defined within portions 30 and 32, respectively, and slidably receive followers 24 and 26, respectively, for permitting reciprocal axial displacement therein. Portions 30 and 32 restrain followers 24 and 26, respectively from all but axial and rotational displacement from their illustrated positions. Lubrication is provided to each follower 24 and 26 via an oil gallery 36 within block 10 in a manner well-known in the art.

Because the structural details of each follower 24 and 26, portions 30 and 32 of boss 18 and their relationship within block 10 are substantially identical, only the details and operation of one will be given herein, it being understood that said explanation is exemplary in nature and applies equally to all the devices within a given application.

Follower 24 includes a cylindrical body portion 38, the outer surface of which slidingly interfaces with the portions of boss 18 defining bore 20. The lower end of body portion 38, as viewed in FIG. 3, extends downwardly beyond a lower surface 40 of boss 18 (and web 34}, and terminates into downwardly depending bifurcated roller mounting members 42. A roller 44 is secured for rotation with respect to follower 24 by a connecting pin 46 passing through mounting member 42 and roller 44. Suitable bearings (not illustrated) would be provided at the interface between pin 46 and roller 44. The outer circumferential surface of roller 44 is in continuous rolling engagement with the surface of a mating lobe 48 of a cam shaft 50 carried within block 10 intermediate banks 12 and 14, in the usual manner. Cam 50 is illustrated with lobe 48 at its apex and thus with follower 24 at its upwardmost limit of travel.

The uppermost end of follower 24 extends above an upper surface 52 of boss 18 and has two parallel flats 54 and 56 formed therein. The uppermost end of body portion 38 is open, providing external access to a piston 58 (refer FIG. 2) disposed therein. As is well-known in the art, one end of a pushrod 60 is maintained in an abutting relationship within a recess 62 defined in the uppermost surface of piston 58. Pushrod 60 is operably engaging an inlet or outlet valve (not illustrated) for the cylinder 16 associated therewith. Accordingly, as cam 50 and lobe 48 rotates, roller 44 will also rotate to mitigate friction and follower 24 and pushrod 60 will axially reciprocate. The axial positioning of follower 24 is determined by virtue of its continuous contact with pushrod 60 and cam 50.

Figure 4:
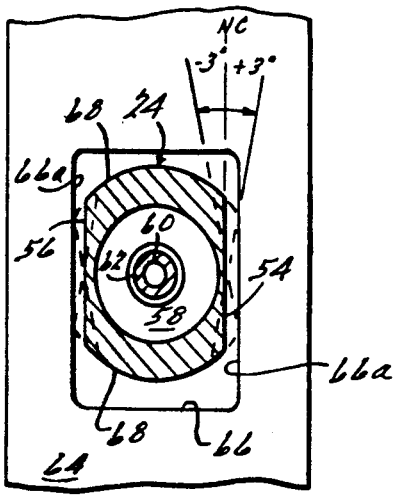
FIG. 4, is a cross-sectional view taken on line 4—4 of FIG. 3.

To ensure that follower 24 is restrained rotationally so that the axis of roller 44 remains substantially parallel to that of cam 50, follower 24 is keyed to a guide bar 64 as will be described in detail hereinbelow. Guide bar 64 is an elongated metal member having generally rectangular aperture 66 therein through which passes the portion of body 38 defining flats 54 and 56. As can best be seen in FIG. 4, aperture 66 and flats 54 and 56 are dimensioned to substantially restrain the rotational freedom of follower 24 by keying or interlocking the two. In the broadest sense of the present invention, guide bar 64 need merely substantially restrain follower 24 from rotational freedom. This can be achieved in any one of several ways wherein guide bar 64 is, itself, prevented from rotation with respect to block 10. Guide bar 64 could be wedged or pinned to block 10 at a point spaced from aperture 66, or could be restrained by virtue of its being keyed to at least two followers 24 and 26. However, in the intended preferred embodiment, guide bar 64 would extend the entire length of banks 12 and 14 of block 10 to entrap or key each of the followers therein. Although it is ultimately desireable to maintain perfect axial alignment of roller 44 and cam 50, manufacturing tolerances and variations, as well as in-use degradation makes this goal difficult to obtain. Additionally, the applicant has determined that a certain amount of rotational freedom is desireable if retained within predetermined limits and, in operation, will cause roller 44 to axially track with cam 50 and thus retain proper rotational positioning of follower 24 over the life of the engine. If this range of freedom is exceeded, scuffing between the roller 44 and cam 48 will occur, which will reduce engine efficiency and useful life.

To provide for a limited range of rotational freedom for follower 24, aperture 66 is dimensioned slightly greater than the spacing of flats 54 and 56. Thus, when follower 24 is at a nominal center position (designated N.C.) follower 24 does not contact guide bar 64, and follower 24 is otherwise free to rotate in either direction until the point of intersection of flats 54 and 56 and the outer diameter 68 of follower 24 contacts the adjacent wall portion **66*a* of aperture 66 as is illustrated in phantom FIG. 4. Thus, the applicant has determined that careful dimensioning of outer diameter 68, flats 54 and 56 and aperture 66 can effect a predetermined range of rotational freedom of follower 24**. The applicant found that a range of $\pm 3$ degrees yields acceptable performance for a particular application. However, it is contemplated that this range will vary depending upon the application to which the present invention is employed.

Guide bar 64 is positioned at a point adjacent upper surface 52 of boss 18. An annular bore spacer 72 is disposed intermediate the lower surface of guide bar 64 and upper surface 52 and is in an abutting relationship therewith. Spacer 72 lies entirely under guide bar 64 and defines a stepped bore 74 concentric with bore 20, through which extends body portion 38 of follower 24. Spacer 72 restrains guide bar 64 from downward axial displacement as viewed in FIG. 3 and provides additional effective length to bore 20 to accomodate follower 24, which, will typically be axially longer than a barrel-type lifter for which block 10 has originally been dimensioned. The axial dimension of spacer 72 will, thus, be dependent upon the actual follower 24 employed. Additionally, given full freedom of design, including block 10, it is contemplated that spacer 72 could be eliminated by redimensioning boss 18.

A generally C-shaped spring clip 70 includes an upper leg 76 pressing downwardly on the upper surface of guide bar 64, and a lower leg 78 pressing upwardly against lower surface 40 of boss 18 to embracingly engage guide bar 64, urging it downwardly against spacer 72 and boss 18. The applicant selected 0.031 inch type SAE 1060/1070 spring steel or band stock for clip 70 and mild steel for guide bar 64 and spacer 72. However, various other materials well-known in the art could be substituted, depending upon the intended application, without departing from the spriit of the present invention. Clip 70 is located along guide bar 64 intermediate adjoining pair of followers 24 and 26 associated with a single cylinder 16 for reasons which will be set forth hereinbelow. When a single guide bar 64 is employed for an entire bank 12 and 14, the applicant found two clips 70 provided adequate retention of guide bar 64. It is contemplated that however more or fewer clips 70 could be employed.

Spacers 72 are provided for at least two bores 20 and 22 within the block so as to keep guide bar 64 equally spaced from the top surfaces 52 thereof. The guide bar 64 is thus rigidly retained in its illustrated position. It is prevented from vertical displacement as viewed in FIG. 2 by the frictional engagement of the upper surface of guide bar 64 and upper leg 76 of spring clip 70.

The free end of upper leg 76 of spring clip 70 is bent to partially encompass guide bar 64 and is defined as interconnecting means, shown generally at 80, for interconnecting or interlocking the two to prevent clip 70 from being displaced rightwardly or upwardly as viewed in FIG. 3, due to thermal variations or vibration inherent in the environment of a typical internal combustion engine. Likewise, the lower leg 78 of spring clip 70 is accurately formed to embrace surface 40 as well as the portion of block 10 defining oil gallery 36 to prevent displacement of clip 70 in the direction indicated by arrow 82. Thus, the arcuate shape of lower leg 78 constitutes interconnecting means, shown generally at 84, for the retention of clip 70 in its illustrated position. Although securely retained in its illustrated position, clip 70, can be easily removed by grasping the free end of lower leg 78 and momentarily deforming clip 70 to move the free end of lower leg 78 counterclockwise, as viewed in FIG. 3. Once lower leg 78 is released from lower surface 40 of boss 18 and has cleared portions 30 and 32, the counterclockwise rotation of clip 70 can be continued to release upper leg 76 (interconnecting means 80) from guide bar 64 for the removal of follower guide 28 from block 10.

Referring to FIG. 5, interconnecting means 84 is illustrated in greater detail. Lower leg 78 is disposed intermediate cylindrical portions 30 and 32 of boss 18. The outer surfaces of cylindrical portions 30 and 32 have an area of minimum spacing along the centerline thereof of a dimension designated S. Lower leg 78 of clip 70 has a nominal dimensional width designated N. Lower leg 78 defines an intermediate necked area 86, which falls upon a centerline drawn between portions 30 and 32. Lower leg 78 transitions dimensionally from its nominal width N to a minimum or necked width designated W, and back to its nominal width N. When the respective dimensions are maintained according to the relationship $N>S>W$, lower leg 78 of clip 70 will nest between cylindrical portions 30 and will be retained thereby, both along the line of elongation of guide bar 64 as well as in the direction indicated by arrow 82.

Figure 6:
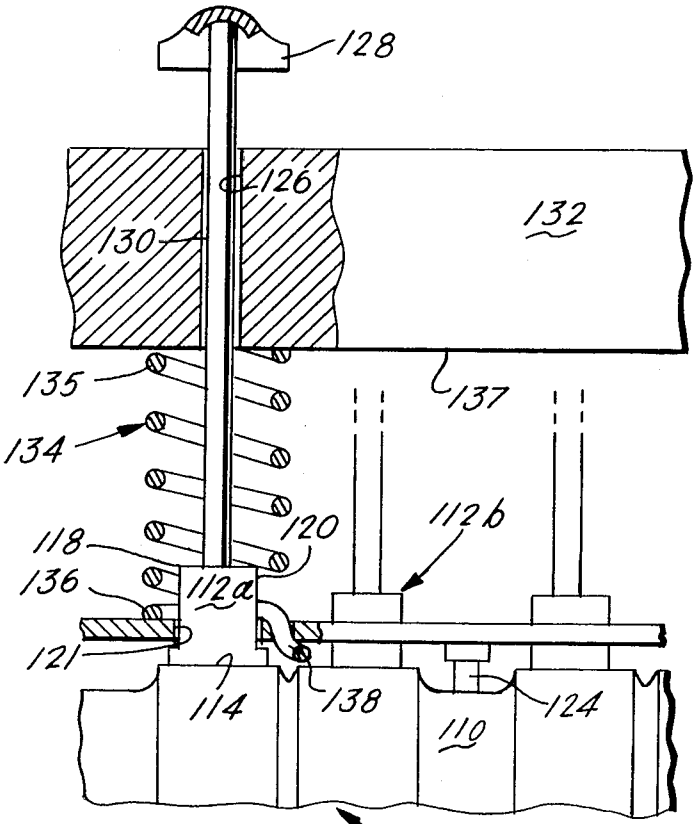
FIG. 6, is a fragmented cross-sectional view of an alternative embodiment of the present invention.

Referring to FIG. 6, an alternative embodiment of the present invention and a variant thereof are illustrated. An internal combustion engine includes a block 110 carrying a number of pairs of roller cam followers 112*a* and 112*b* for reciprocation in the usual manner to control timing events of the valve train. The upper portions of followers 112 extend above an upper surface 114 defined by bosses, shown generally at 116, formed integrally in block 110, as was described hereinabove in connection with FIGS. 1 through 3. Followers 112 have flats 118 and 120 formed therein for keying to mating apertures 121 in a guide plate 122.

Guide plate 122 is spaced from surface 114 a predetermined distance by spacer blocks 124, disposed between the lower surface of plate 122 and the upper surface of block 110. Preferably, two such blocks 124 would be employed per cylinder bank in block 110 at points adjacent two distal follower pairs. Each block 124 can be integrally formed in block 110, plate 122 or separately formed and retained by means (not illustrated) in its intended position. Pushrods 130 interconnect the piston (not illustrated) of each follower 112 with a rocker arm 128 in the usual manner. In so doing, the pushrods 130 freely extend through bores 126 in a cylinder head 132 overlying the portion of block 110 defining bosses 116. Biasing means such as a plate retaining springs 134 are provided concentrically with pushrod 126 and each have an upper end 135 bearing upwardly against the lower surface 137 of head 132, and a lower end 136 bearing downwardly against the upper surface of plate 122 to urge plate 122 toward boss 116. Lower end 136 of spring 134 terminates in a clip 138 which is formed to embrace a portion of plate 122 to prevent relative rotation of spring 134 and plate 122.

In an alternative confirguration illustrated in FIG. 6, anchoring of the upper end 135 of spring 134 is accomplished by an elongated cantilever member such as a bolt or stud 140 threadably engaging block 110 extending concentrically within spring 134. The free end of stud 140 carries a head or retainer portion 142, positioned by a nut 144, which has a lower surface 145 abutting with the upper end 135 of spring 134. Spring 134 bears upwardly against retainer 142 and downwardly against the upper surface of plate 122 to retain the latter in its illustrated position. Stud 140 extends freely through registering apertures 146 and 148 in plate 122 and spacer block 124, respectively, to provide locating therefor.

It is to be understood that the invention has been described with reference to a specific embodiment which provides the features and advantages previously described and that such specific embodiment is susceptible to modification as will be apparent to those skilled in the art. For example, it is contemplated that the spring clip can be integrally formed with the guide bar. Accordingly, the following description is not to be construed in a limiting sense.

What is claimed:

1. In an internal combustion engine having a block, cylinder head and valve train with a plurality of roller cam followers slidably received in a bore in the engine block, and follower guide means, the improvement comprising:

(a) means defining a guide surface on each of said; followers (b) a guide member received over a plurality of said followers and having cooperating surfaces therein slidably contacting said guide surface on each follower and operative to permit limited rotation thereof during slidable movement of said follower with respect to said guide means;

(c) a coil spring biasing said guide member against said block, said guide member being otherwise floating, said coil spring having one end thereof registering on portions of the engine cylinder head and the opposite end thereof contacting said guide member, the end contacting said guide member including an end portion engaging a cooperating surface on said guide member for preventing rotation of said spring.

2. The improvement defined in claim 1, wherein the end of said spring means registering against portions of the cylinder head registers against the undersurface thereof at the parting line with said block.

3. The improvement defined in claim 1, wherein said end portion is displaced outward and downward beyond the cylinder defined by the active coils of the spring to defined a clip engageable with an edge surface of said guide member.

* * * * *